US005261556A

United States Patent [19]

Gatto

[11] Patent Number: 5,261,556

[45] Date of Patent: Nov. 16, 1993

[54] MODULAR TOOL AND HARDGOODS ORGANIZER AND STORAGE UNIT FOR A BUCKET

[76] Inventor: Michael F. Gatto, 440 Boston Rd., Sutton, Mass. 01527

[21] Appl. No.: 828,774

[22] Filed: Jan. 30, 1992

[51] Int. Cl.[5] ..... B65D 85/20

[52] U.S. Cl. ..... 220/529; 220/406; 206/373

[58] Field of Search ..... 220/408, 527, 528, 529, 220/735; 206/373

[56] References Cited

U.S. PATENT DOCUMENTS

| | | | |
|---|---|---|---|
| 1,018,492 | 2/1912 | Hilton et al. | 220/527 X |
| 2,646,808 | 7/1953 | Yenne | 220/408 X |
| 3,547,303 | 12/1970 | Mascia et al. | 220/529 X |
| 4,867,332 | 9/1989 | Mains | 220/85 H |
| 4,925,026 | 5/1990 | McKay | 206/373 |
| 4,947,998 | 8/1990 | Smeller | 206/373 X |
| 4,993,551 | 2/1991 | Lindsay | 206/373 |
| 5,088,618 | 2/1992 | Colombo | 220/408 |
| 5,092,463 | 3/1992 | Dees | 206/373 |

*Primary Examiner*—Steven M. Pollard
*Attorney, Agent, or Firm*—Daniel J. Bourque

[57] ABSTRACT

A modular tool and hardgoods organizer and storage unit converts the interior of a bucket into a number of tool and hardgoods storage units. A plurality of bucket interior divider segments divides the interior of the bucket into a number of storage areas. At least one organizer and storage assembly is disposed within each one of the storage areas. The storage and organizer assemblies are movable between a first retracted position within the interior of the bucket and a second extended position to the exterior of the bucket. Each of the organizer and storage assemblies includes storage elements such as a tool holder having tool storage receptacles and a hardgoods storage compartment. The storage elements may be permanently coupled to the organizer and storage assemblies or the bucket interior divider segments. Alternatively, the storage elements may be slidably coupled by means of grooves or slots. Also included are support assemblies movable between first and second positions, for maintaining the organizer and storage assemblies in an extended position, and for allowing the organizer and storage assemblies to be returned to an enclosed position within the interior of the bucket when the support assemblies are moved to a second retracted position.

23 Claims, 5 Drawing Sheets

MODULAR TOOL AND HARDGOODS ORGANIZER AND STORAGE UNIT FOR A BUCKET

FIELD OF THE INVENTION

This invention relates to storage containers and more particularly, to a tool and hardgoods organizer of modular design which is inserted in a bucket or pail.

BACKGROUND OF THE INVENTION

Most tradespersons such as carpenters, plumbers and electricians as well as homeowners, frequently need an inexpensive device for storing and organizing tools and supplies.

One such device which is frequently available around both the workplace and the home is a five gallon plastic bucket or pail with handles, of the type which originally contained such products as paint and sheetrock compound. These buckets are sturdy, waterproof and most importantly, are readily available for little or no charge after being discarded by the user of their original contents.

Unmodified, these buckets are not capable of organizing and making easily accessible smaller tools and assorted other supplies or items since all items placed in the bucket fall to the bottom of the pail.

One attempt at providing a more organized tool holder for such a bucket is described in U.S. Pat. No. 4,993,551 which discloses a cloth storage device which drapes over both the inside and outside surfaces of the bucket, and which provides a number of inner and outer storage pockets. Although such storage pockets are appropriate for a variety of tools, small items or supplies such as nuts, bolts, screws, electrical wire nuts and plumbing fixtures cannot be easily accessed or seen in such a pouch. Additionally, the inside of the bucket remains completely unused. Further, tools stored on the outside surface of the bucket are exposed to the weather and may fall from the pouch when in transit.

Another quite similar attempt at providing a bucket organizer is disclosed in U.S. Pat. No. 4,867,332 wherein is disclosed a tool holder which engages with the upper rim of the bucket. The short comings of this disclosed device also include the utilization of only a small portion of the bucket for storage as well as the inability to cover the contents with the original bucket cover.

SUMMARY OF THE INVENTION

Accordingly, the present invention provides an apparatus which converts essentially the entire interior of a bucket into one or more tool and hardgoods storage and organizer units. The tool and hardgoods organizer of the present invention provides for modular design which allows the user to arrange and rearrange as required, the configuration of the organizer and storage assemblies.

The apparatus of the present invention includes a plurality of bucket interior divider segments which divide essentially the entire interior of the bucket into at least a corresponding plurality of storage areas. Also included are a plurality of organizer and storage assemblies, each of which are disposed within one of the storage areas formed by the bucket interior divider segments. The organizer and storage assemblies are movable between a first retracted position within the interior of the bucket, and a second extended position to the exterior of the bucket and from which second extended position tools and hardgoods may be accessed. Each of the organizer and storage assemblies includes one or more storage elements which provide a number of organizer and storage receptacles for one or the other or both of tools and hardgoods.

In the preferred embodiment, the storage elements are coupled to the organizer and storage assemblies which are inserted within each of the bucket interior storage areas. The storage elements may be permanently fixed to the organizer and storage assemblies or alternatively, be slidably coupled by means of slots or grooves, thus allowing the storage elements to be rearranged or reconfigured. In another embodiment, the storage elements are coupled directly to the bucket interior divider segments.

The storage elements may include a tool holder having a number of tool storage receptacles such as rectangular slots or generally circular holes. The storage elements may also include a hardgoods storage compartment assembly including a storage compartment bottom portion and a storage compartment end wall portion. The storage compartment end wall portion includes a radial curvature which generally corresponds to the radial curvature of the wall of the bucket. The bottom and radially curved end wall portion of the storage compartment are disposed proximate one another to provide a hardgoods storage receptacle. In one embodiment, the end wall is integral with and affixed with the storage compartment bottom portion while in a second embodiment, the end wall is separate and removable from the storage compartment bottom portion.

In the preferred embodiment, the modular tool and hardgoods organizer and storage unit of the present invention is fabricated from an inexpensive, light weight, durable and easily workable material such as plastic or lexan. Thus, the bucket interior divider segments may be formed by gluing or otherwise cementing a number of portions together.

In the preferred embodiment, first and second bucket interior divider segments form four bucket interior storage areas. Further, the first and second bucket interior divider segments in the preferred embodiment each include an opening beginning along one edge of the interior divider segment which has a length generally equal to the diameter of the bucket. The opening extends along the length of the bucket interior divider segment to a point approximately one-half way up the length of the segment, at approximately the central region of the interior divider segment. When in use, the opening from the first bucket interior divider segment engages with the opening of the second bucket interior divider segment to allow one of the bucket interior divider segments to be rotated generally perpendicular to the other bucket interior divider segment, thus forming four generally equally sized storage areas.

In the preferred embodiment, one or the other of the bucket interior divider segments or the segments which form the storage and organizer assemblies include grooves or slots which allow the storage elements such as tool holders and hardgoods compartments to be slidably engaged and disengaged. The storage elements engage with pairs of horizontally or downwardly sloping grooves thus allowing tool holders and storage compartments to be inserted horizontally or downwardly sloping. Further, the horizontal grooves may include first and second groove portions separated by non-grooved portions, for allowing storage elements to be inserted in a horizontal or downwardly sloping position.

The invention also includes a plurality of support assemblies, movable between first and second positions, for maintaining each of the plurality of organizer and storage assembly in an extended position when the support assembly is in a first extended position, and for allowing the organizer and storage assemblies to be returned to a position enclosed within the interior of the bucket when the support assembly is moved to a second retracted position.

DESCRIPTION OF THE DRAWINGS

These, and other features and advantages of the present invention will be better understood by reading the following detailed description, taken together with the drawings wherein.

DETAILED DESCRIPTION OF THE INVENTION

Figure 1:
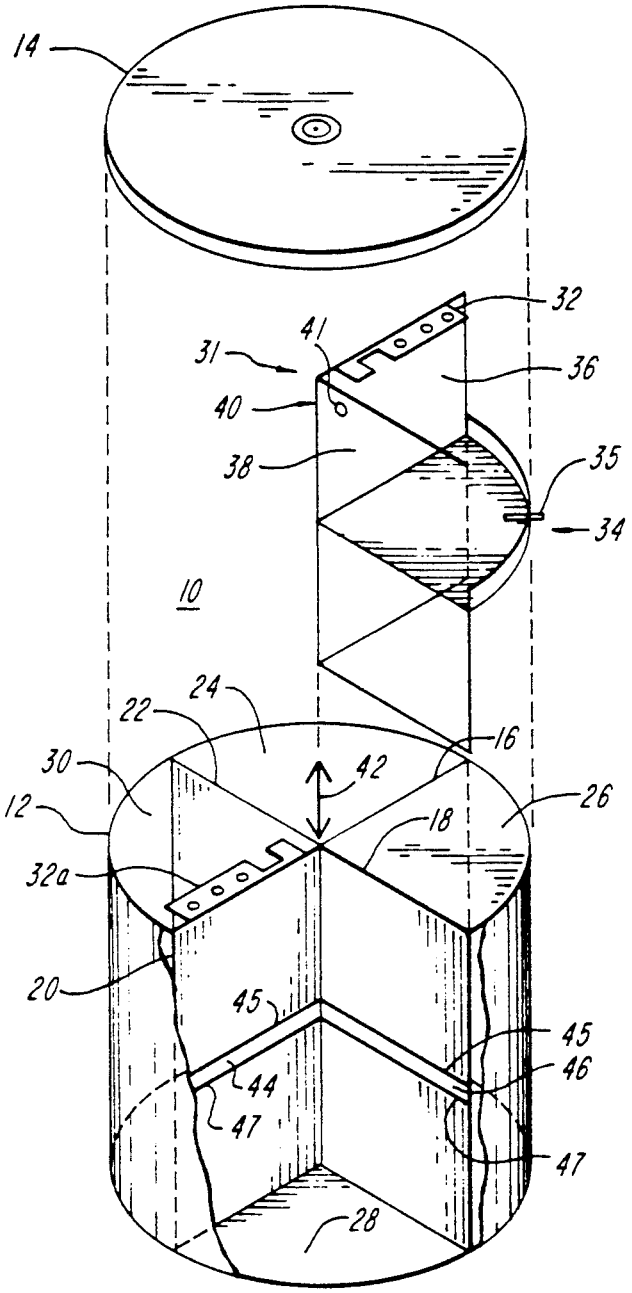
FIG. 1 is a perspective exploded view of a bucket in which has been inserted the modular organizer and storage unit of the present invention.

The modular tool and hardgoods organizer 10, FIG. 1, according to the present invention is adapted to convert the interior space of a bucket 12 into a plurality of storage areas. Bucket 12 is typically a five gallon plastic bucket featuring a handle (not shown) and a cover 14 which fits snugly over the rim of bucket 12.

The tool and hardgoods organizer of the present invention includes bucket interior divider segments 16–22. The bucket interior divider segments divide essentially the entire interior of the bucket into a corresponding plurality of storage areas 24–30. Each of the storage areas 24–30 further includes at least one organizer and storage assembly. Examples of organizer and storage assemblies include a tool organizer 32 and a hardgoods storage compartment assembly 34.

For purposes of describing the present invention, the term "tools" is to be given its broadest interpretation and includes, but is not limited to, hammers, wrenches, screwdrivers, torches and in short, any type of hand held tools or portions of larger tools, which would fit within such a bucket and typically be carried by a tradesperson, homeowner, repair person, etc. Similarly, hardgoods include, but are not limited to, nuts, bolts, screws, electrical wire connectors, plumbing fixtures, sewing and craft supplies, sports equipment, or other similar items which would fit well within a compartment.

In the preferred embodiment, the organizer and storage assembly 31 of the present invention includes first and second assembly forming segments 36 and 38 respectively. The first and second assembly forming segments are coupled at one end 40 proximate a vertical axis 42 which passes through the center of the interior of the bucket.

In the preferred embodiment, the organizer and storage assembly 31 is removably disposed within a storage area such as storage area 26. Each of the assembly forming segments 36,38 are disposed proximate adjacent the bucket interior divider segments such as divider segments 16 and 18 respectively. In the preferred embodiment, the organizer and storage elements such as tool organizer 32 and storage compartment 34 are coupled directly to the first and second assembly forming segments. Thus, each of the organizer and storage assemblies 31 may be separately accessed or moved from a first retracted position within the interior of the bucket, to a second extended position from which tools or hardgoods may be retrieved from the storage and organizer assembly.

Each of the organizer and storage assemblies 31 may also further include a hole or slight protrusion 41 near the top of the assembly, to allow the user to lift the assembly out of the bucket.

In another embodiment, the storage elements such as tool organizer **32*a* may be coupled directly to one or more of the bucket interior divider segments 20,22. In a further embodiment, the bucket interior divider segments may include pairs of grooves such as grooves 44,46. Each groove is formed by first and second rails 45,47 respectively. The pairs of grooves are formed in opposite and adjacent bucket interior divider segments and cooperate to allow an organizer and storage element such as tool holder 32 or storage compartment 34** to be slidably inserted and supported by the grooves. Additional examples and embodiments will be described hereinafter.

A further feature of the present invention is that the storage assemblies 31 may be raised and held in an extended position by utilizing one or more support assemblies. One example of a support assembly includes providing each of the storage compartments 34 with a groove or slot in the bottom portion, and into which is inserted a spring loaded pin. When the storage assembly is raised, the pin rides along the inside of the storage bucket. Once the pin is raised above the bucket rim, the pin is forced outwardly and maintains the storage assembly in the raised position.

To return the storage assembly to the bucket, the user merely retracts the pin and slides the storage assembly into the bucket. Multiple storage compartments within a storage assembly may each have a support assembly for selectively adjusting the raised height of the storage assembly. Other examples of support assemblies will be described herein.

Figure 2:
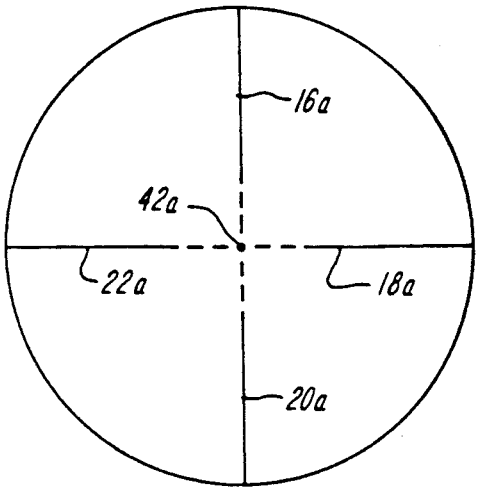
FIG. 2 is a top view of the interior of the bucket divided according to one embodiment of the invention.

In the preferred embodiment, the modular tool and hardgoods organizer and storage unit of the present invention divides the interior of the bucket into four generally equal segments as shown further in FIG. 2. The preferred embodiment contemplates that the tool and hardgoods organizer and storage unit of the invention is fabricated from an inexpensive, and easy to work with material such as plastic, lexan, etc. Accordingly, the bucket interior storage areas may be formed by four separate interior divider segments 16a–22a which are glued or otherwise joined about the center axis 42a of the bucket. In a first alternative embodiment, two non-adjacent bucket interior divider segments which together traverse the diameter of the bucket such as divider segments 16a and 20a may be formed from one sheet of material, while the two remaining and intersecting bucket interior divider segments 18a and 22a may be cemented, glued, or otherwise joined to the one larger segment.

Figure 3:
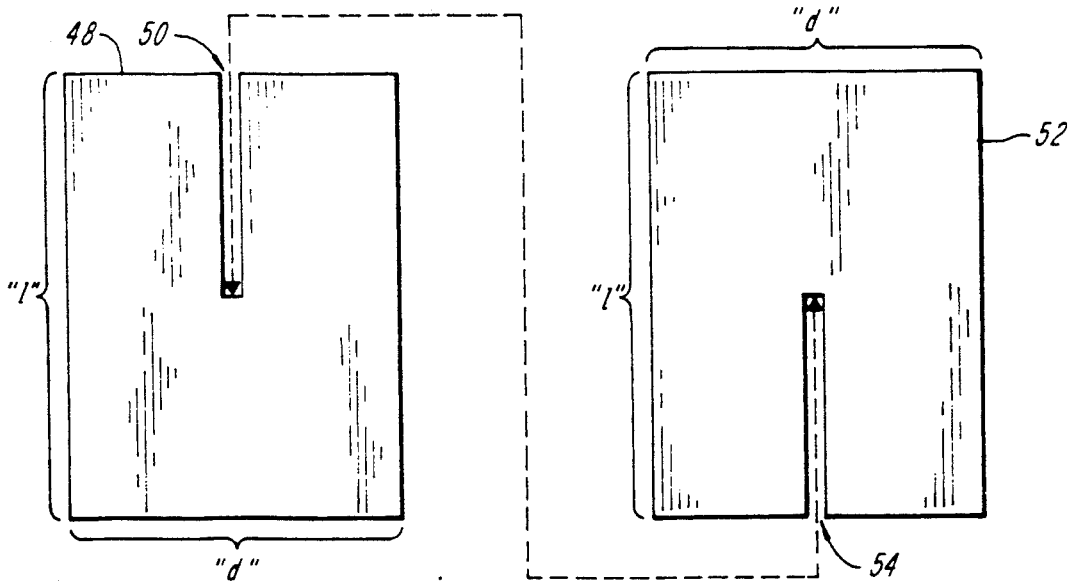
FIG. 3 is a plan view of a method of forming the bucket interior divider segments according to one embodiment of the present invention.

For ease of fabrication and shipment, however, the preferred embodiment includes four storage areas which are formed utilizing two interior divider segments, each of which spans the entire diameter of the bucket. As shown in FIG. 3, a first interior divider segment 48 having a width of "d" which corresponds to the diameter of the interior of the bucket is provided. First interior divider segment 48 includes a slot 50 extending from one end of segment 48 approximately one-half way up length "l" of the divider segment along the middle or center of the divider segment.

A second generally identical divider segment 52 is provided which includes a slot or opening 54 which is also approximately centrally located along the width "d" of the divider segment and also extends approximately one-half way up length "l" to approximately the center of the divider segment. By rotating one or the other of the first or second interior divider segments 48 or 52 by 90 degrees, perpendicular with respect to the other segment and with respect to the plane of the page. and by engaging slot or opening 54 with slot or opening 50, a four segment storage area as shown in FIGS. 1 and 2 may be easily and quickly provided. Interior divider segments of such design would also simplify the manufacturing process in that only one template or mold is necessary. The pieces are identical and are merely inverted with respect to one another. Additionally, product shipping is also greatly simplified given that the interior divider segments can be shipped in one flat package.

Figure 4A:
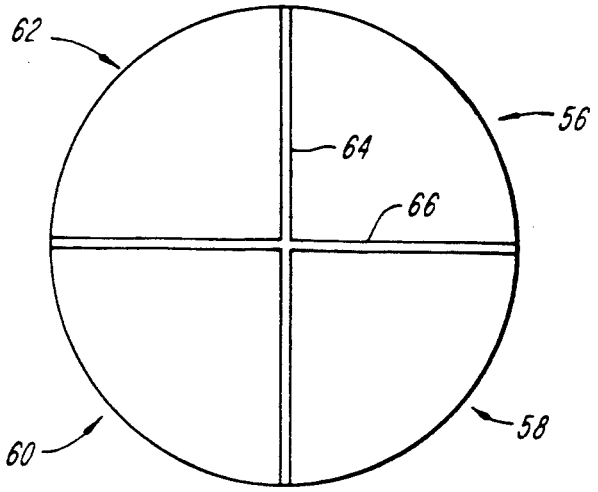
FIGS. 4A–4C are alternative methods of dividing the interior of a bucket according to alternative embodiments of the invention.
Figure 4B:
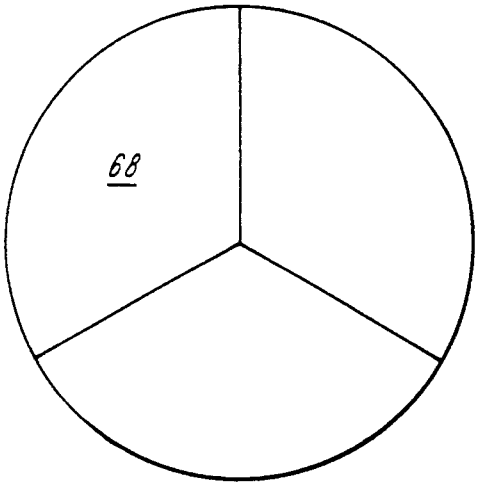
Figure 4C:
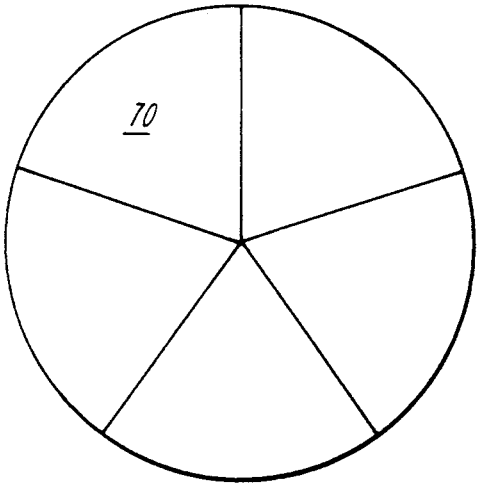

Alternative embodiments for forming interior storage areas for the modular tool and hardgoods organizer and storage unit of the present invention are shown in FIGS. 4A–4C. For example, in FIG. 4A, four distinct and separate storage assemblies 56–62 are provided, each similar to storage assembly 31 described in conjunction with FIG. 1, but without any bucket interior segments. Each of the organizer and storage assemblies includes first and second assembly forming segments 64,66. By placing four of such assemblies adjacent one another, four individually removable storage units are formed.

Although four storage units is considered to be the optimum configuration, a three storage area modular tool and hardgoods storage unit 68, FIG. 4B may be formed by orienting three interior divider segments approximately 120° with respect to each other, and joining them in the center of the bucket. Similarly, a five storage area modular tool and hardgoods organizer and storage unit 70, FIG. 4C, according to another embodiment of the present invention may be formed by joining five interior divider segments. Dividing the interior of a bucket into a greater or lesser number of storage units is also considered to be within the scope of the present invention.

Figure 5A:
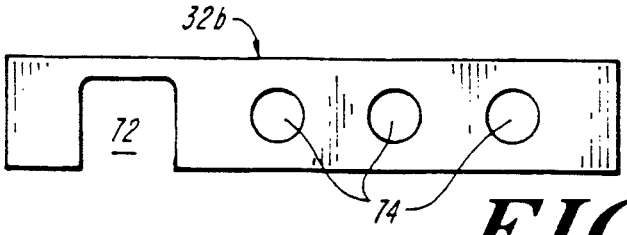
FIGS. 5A and 5B are schematic illustrations of a hardgoods compartment assembly and a tool holder, both showing a plurality of storage receptacles.

As stated above, each organizer and storage assembly includes one or more storage elements. Examples of storage elements include the tool organizer and storage element 32b, FIG. 5A which includes a number of tool storage and organizer receptacles such as slot 72 and one or more generally circular holes 74.

Figure 5B:
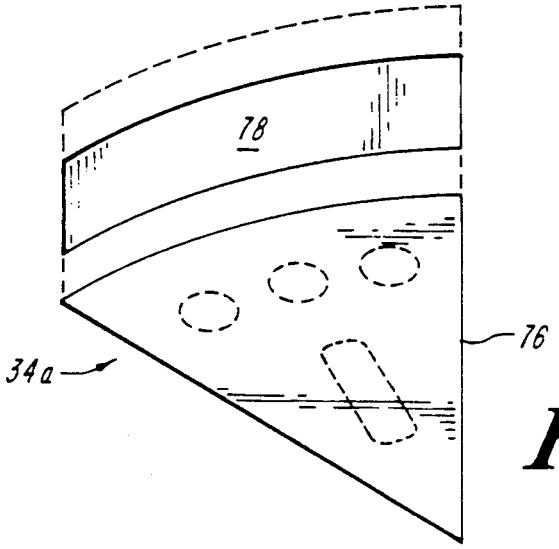

An additional example of a storage element includes storage compartment 34a, FIG. 5B which is comprised of a bottom portion 76 and a radially curved end wall portion 78. The radial curvature of end wall portion 78 corresponds essentially to the radial curvature of the interior (and exterior) wall of the bucket. End wall portion 78 may be of varying heights dependent upon the type and quantity of hardgoods to be stored in the storage compartment. Additionally, end wall portion 78 may be fixed or coupled to, or separable from, bottom portion 76.

Figure 6:
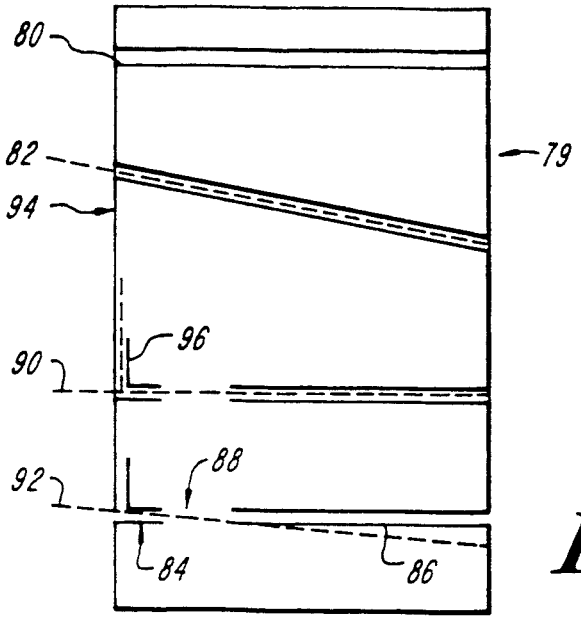
FIG. 6 is a side view of an interior divider segment or an assembly forming segment illustrating organizer and storage element grooves according to another embodiment of the present invention.

In the preferred embodiment, either the interior divider segments or the assembly forming segments include grooves as previously shown and described in conjunction with FIG. 1. FIG. 6 illustrates several examples of grooves contemplated by the present invention including a straight horizontally formed groove 80 which extends horizontally from one edge of the divider or assembly segment to the other as previously described.

Pairs of grooves in adjacent divider or assembly segments cooperate to support storage elements such as tool holders and storage compartments. The present invention also contemplates a slanted groove or slot 82. Such a slanted groove or slot is particularly advantageous when used with storage compartments such as storage compartment 34a, FIG. 5B. Grooves or slots 80 and 82 as well as others described herein may be formed by a cut or groove in the divider or assembly forming segment 79. Alternatively, the grooves or slots may be formed by two parallel, and spaced apart rails, with the space between the rails forming the groove or slot.

In the preferred embodiment, each groove or slot is comprised of a first groove segment 84 and a second groove segment 86. The first and second groove segments are separated by a non-grooved portion 88. Such a three portion groove allows a tool holder, compartment or other storage element to be inserted horizontally a shown by the dashed line 90, or a storage compartment or other storage element to be inserted at a downwardly sloping angle as shown by dashed lines 92. Thus, this one type of groove or slot will accommodate both straight and downwardly slanting storage elements, although the storage elements may be specifically designed for horizontal or slanted installation for the better fit.

In a further embodiment, the edge 94, of assembly or divider segment 79 which is nearest the wall of the bucket may also include a vertical groove 96. The vertical groove allows the user to selectively place storage compartment end wall portions of a selected height where needed. In summary, providing both horizontal and vertical grooves on either the interior divider segments or assembly forming segments gives the user of the modular tool and hardgood organizer complete freedom to design a storage system which best meets his or her needs, and to redesign the organizer and storage unit as his or her needs change.

Figure 7:
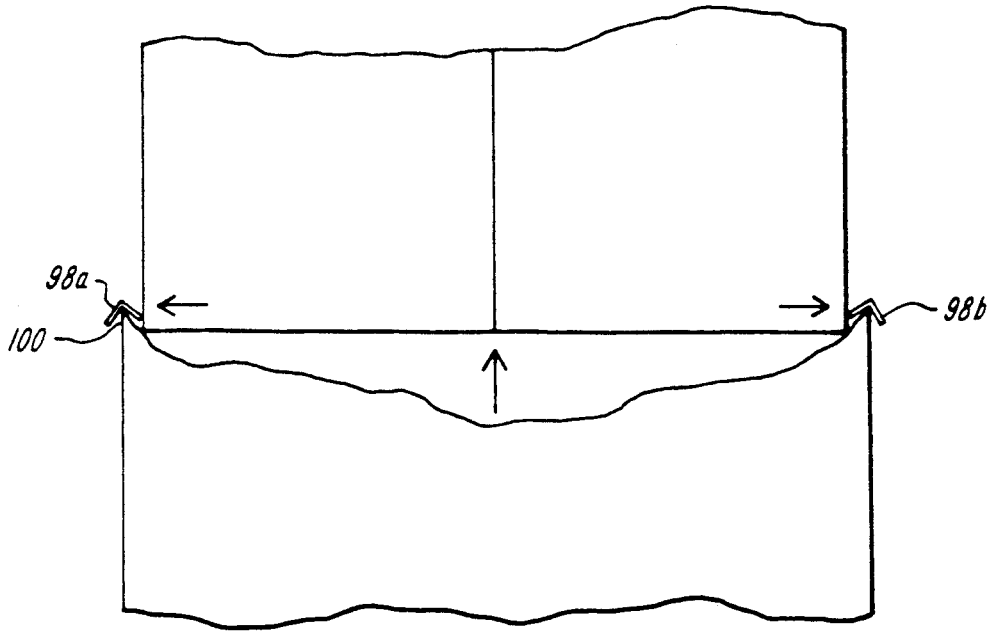
FIG. 7 is a cross sectional view of the tool and hardgoods organizer and storage unit of the present invention in its exposed position supported by support assemblies in their extended condition, according to another feature of the present invention.

A further feature of the modular tool and hardgoods organizer and storage unit of the present invention includes a plurality of support assemblies 98*a*, 98*b*, FIG. 7. The support assemblies may include generally "L" shaped, spring biased devices which, when the modular tool and hardgoods organizer is extracted above the rim 100 of the bucket, automatically engage with the rim to support any or all storage assemblies which have been raised and which include a support assembly.

Figure 8:
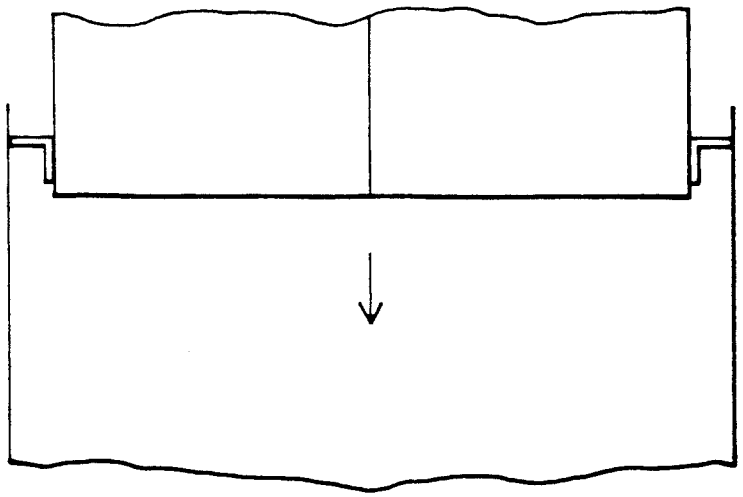
FIG. 8 is a cross sectional view of the modular tool and hardgoods organizer and storage unit of the present invention in a partially enclosed position within the interior of the bucket, illustrating the support assemblies in a retracted condition.

When it is desired to lower the storage assemblie(s) into the storage bucket, the user merely slightly raises the storage assembly, depresses the support assembly against the side of the storage assembly as shown in FIG. 8, and proceeds to lower the storage assembly into the bucket and return the cover to the bucket. Accordingly, by providing each and every storage assembly with its own separate support assembly, each and every storage assembly can be raised and held in the raised position to expose the contents (tools or hardgoods) to the user. Once lowered, the cover may be replaced onto the bucket for safe, weather and spill proof storage and transportation of the contents.

Modifications and substitutions by one of ordinary skill in the art are considered to be within the scope of the present invention, which is not to be limited except by the claims which follow.

I claim:

1. Apparatus for converting the interior of a bucket into one or more tool and hardgoods storage and organizer units, comprising:

a plurality of bucket interior divider segments, for dividing essentially the entire interior of said bucket into at least a corresponding plurality of storage areas; and a plurality of organizer and storage assemblies, one of said organizer and storage assemblies disposed within each one of said storage areas, each of said plurality of organizer and storage assemblies movable between a first retracted position within the interior of said bucket, and a second extended position to the exterior of said bucket, and from which extended position tools and hardgoods may be accessed, each of said organizer and storage assemblies including a plurality of storage elements, each of said plurality of storage elements providing at least one organization and storage receptacles for one or the other or both of tools and hardgoods.

2. The apparatus of claim 1 wherein said storage elements include a tool holder, each tool holder including a plurality of tool storage receptacles.

3. The apparatus of claim 2 wherein said plurality of tool storage receptacles include at least one rectangular slot.

4. The apparatus claim 2 wherein said plurality of tool storage receptacles include at least one generally circular hole.

5. The apparatus of claim 1 wherein said storage elements include a hardgoods storage compartment assembly, said assembly including a storage compartment bottom portion and a storage compartment end wall portion, said storage compartment end wall portion having a radial curvature generally corresponding to a radial curvature of an interior wall of said bucket, said bottom portion and said radially curved end wall portion disposed proximate one another, and cooperating to provide a hardgoods storage receptacle.

6. The apparatus of claim 5 wherein said hardgoods storage compartment end wall portion is integral with and affixed to said storage compartment bottom portion, to form said hardgoods storage compartment assembly.

7. The apparatus of claim 5 wherein said hardgoods storage compartment end wall portion is separate and removable from said hardgoods storage compartment bottom portion.

8. The apparatus of claim 1 wherein said plurality of organizer and storage assemblies are removably disposed within said corresponding plurality of storage areas.

9. The apparatus of claim 8 wherein each of said removably disposed organizer and storage assemblies includes first and second assembly forming segments, said first and second assembly forming segments coupled at one end proximate a vertical axis which passes through the center of said bucket interior, said first and second assembly forming segments disposed proximate first and second bucket interior divider segments; and wherein said plurality of organizer and storage elements are coupled to said first and second assembly forming segments.

10. The apparatus of claim 9 wherein said organizer and storage elements include at least one of a tool holder and a storage compartment assembly, said storage compartment assembly including a storage compartment bottom portion and a storage compartment end wall portion, said storage compartment end wall portion having a radial curvature generally corresponding to a radial curvature of an interior wall of said bucket, said storage compartment bottom portion and said storage compartment radially curved end wall portion disposed proximate one another, and cooperating to provide a hardgoods receptacle.

11. The apparatus of claim 10 wherein each of said first and second assembly forming segments include a plurality of pairs of downwardly sloping aligned grooves, a first groove of each of said pair of grooves disposed on said first assembly forming segment, and a second groove of each of said pair of grooves disposed on said second assembly forming segment opposite and aligned with said first groove of each pair of grooves, said plurality of pairs of downwardly sloping aligned grooves sloping downwardly from a first position on said assembly forming segments proximate a wall of said bucket toward a second position on said assembly forming segments disposed at approximately the center of said bucket, each of said pair of grooves cooperating to allow one of said tool holder and said storage compartment assembly to be slidably inserted and supported by said pair of grooves in a downwardly sloping position.

12. The apparatus of claim 11 wherein each of said support assemblies includes spring biasing means, for automatically urging and moving said support assemblies to said first extended position.

13. The apparatus of claim 10 wherein said first and second assembly forming segments include a plurality of pairs of horizontally aligned grooves, a first groove of each of said pair of grooves disposed on said first assembly forming segment, and a second groove of each of said pair of grooves disposed on said second assembly forming segment opposite and horizontally aligned with said first groove of each pair of grooves, each of said pair of grooves cooperating to allow at least one of said tool holder and said storage compartment assembly to be slidably inserted and supported by said pair of horizontal grooves, and slidably coupled to said first and second assembly forming segments.

14. The apparatus of claim 13 wherein said first and second assembly forming segments further include a plurality of pairs of vertically aligned grooves, each of said pair of vertically aligned grooves cooperating to allow said radially curved end wall portion of said storage compartment assembly to be slidably inserted and supported by said pair of vertical grooves.

15. The apparatus of claim 13 wherein each groove of said pairs of grooves is comprised of first and second groove segments, said first and second groove segments separated by a non-grooved segment.

16. The apparatus of claim 1 wherein each of said organizer and storage elements are coupled to first and second adjacent bucket interior divider segments.

17. The apparatus of claim wherein said first and second adjacent bucket interior divider segments include a plurality of pairs of horizontally aligned grooves, a first one of each of said pair of said grooves disposed on said first adjacent interior divider segment, and a second one of each of said pair of grooves disposed on said second adjacent interior divider segment opposite and horizontally aligned with said first one of each pair of grooves, each of said pair of grooves cooperating to allow at least one of said tool holder and said storage compartment assembly to be slidably inserted and supported by said pair of horizontal grooves, and slidably coupled to said first and second adjacent interior divider segments.

18. The apparatus of claim 17 wherein said first and second adjacent bucket interior divider segments further include a plurality of pairs of vertically aligned grooves, each of said pair of vertically aligned grooves cooperating to allow said radially curved end wall portion of said storage compartment assembly to be slidably inserted and supported by said pair of vertical grooves.

19. The apparatus of claim 17 wherein each groove of said pair of grooves is comprised of first and second groove segments, said first and second groove segments separated by a non-grooved segment.

20. The apparatus of claim 17 wherein each of said first and second adjacent bucket interior divider segments include a plurality of pairs of downwardly sloping aligned grooves, a first groove of each of said pair of grooves disposed on said first adjacent interior divider segment, and a second groove of each of said pair of grooves disposed on said second adjacent interior divider segment opposite and aligned with said first groove of each pair of grooves, said plurality of pairs of downwardly sloping aligned grooves sloping downwardly from a first position on said adjacent interior divider segments proximate a wall of said bucket toward a second position on said adjacent interior divider segments disposed at approximately the center of said bucket, each of said pair of grooves cooperating to allow one of said tool holder and said storage compartment assembly to be slidably inserted and supported by said pair of grooves in a downwardly sloping position.

21. The apparatus of claim 20 wherein in said extended position, said support assemblies engage with a portion of a rim of said bucket, for maintaining each of said plurality of organizer and storage assemblies in said exposed position.

22. The apparatus of claim 1 wherein each of said plurality of organizer and storage assemblies further includes a support assembly movable between first and second positions, for separately maintaining each of said plurality of organizer and storage assemblies in said extended position when said support assembly is in a first extended position, and wherein said support assembly is movable to a second retracted position for allowing said plurality of organizer and storage assemblies to be returned to said enclosed position within the interior of said bucket.

23. The apparatus of claim 1 wherein said plurality of bucket interior divider segments includes first and second bucket interior divider segments, each of said first and second bucket interior divider segments having a predetermined length and width which generally corresponds to a depth and diameter of said bucket interior respectively;

said first bucket interior divider segment including an opening beginning at a point along a first edge of said first interior divider segment having a width generally equal to said bucket diameter, and extending a predetermined distance toward a second parallel and opposing edge of said first bucket interior divider segment also having a width generally equal to said bucket diameter, said predetermined distance of said opening generally equal to one-half the predetermined length of said first bucket interior segment;

said second bucket interior divider segment including an opening beginning at a point along a first edge of said second interior divider segment having a width generally equal to said bucket diameter, and extending a predetermined distance toward a second parallel and opposing edge of said second bucket interior divider segment also having a width generally equal to said bucket diameter, said predetermined distance of said opening generally equal to one-half the predetermined length of said second bucket interior segment; and said opening on said first bucket interior divider segment engaging with said opening on said second bucket interior divider segment, for allowing one of said first and second bucket interior divider segments to be rotated and positioned perpendicular to the other of said first and second bucket interior divider segments, for forming four, generally equally sized storage areas.

* * * * *